US011312603B2

(12) United States Patent
O'Keeffe et al.

(10) Patent No.: US 11,312,603 B2
(45) Date of Patent: Apr. 26, 2022

(54) LOAD REST

(71) Applicant: Palfinger AG, Bergheim bei Salzburg (AT)

(72) Inventors: Eric O'Keeffe, Monaghan (IE); Christian Wernle, Steinfeld (AT)

(73) Assignee: PALFINGER AG, Bergheim bei Salzburg (AT)

( * ) Notice: Subject to any disclaimer, the term of this patent is extended or adjusted under 35 U.S.C. 154(b) by 216 days.

(21) Appl. No.: 16/739,849

(22) Filed: Jan. 10, 2020

(65) Prior Publication Data

US 2021/0214200 A1 Jul. 15, 2021

(51) Int. Cl.
*B66F 9/12* (2006.01)
*B66F 9/075* (2006.01)

(52) U.S. Cl.
CPC ..... *B66F 9/12* (2013.01); *B66F 9/07504* (2013.01); *B66F 9/07559* (2013.01)

(58) Field of Classification Search
CPC .... B66F 9/07504; B66F 9/07563; B66F 9/12; B66F 9/18
See application file for complete search history.

(56) References Cited

U.S. PATENT DOCUMENTS 7,001,131 B2 * 2/2006 O'Keeffe ..... B66F 9/07563 414/467
7,632,054 B2 * 12/2009 McGrane ..... B66F 9/07559 414/475

FOREIGN PATENT DOCUMENTS

CN 111689436 A * 9/2020

* cited by examiner

*Primary Examiner* — Diem M Tran
(74) *Attorney, Agent, or Firm* — Wenderoth, Lind & Ponack, L.L.P.

(57) ABSTRACT

A forklift includes a vehicle frame, wherein at least one load rest platform is movably arranged on the vehicle frame. The at least one load rest platform is movable between a storage position, in which no load can be deposited on the at least one load rest platform, and a working position, in which a load can be deposited on the at least one load rest platform. The at least one load rest platform is aligned essentially horizontally when moved to the working position, and the at least one load rest platform is movably arranged on an upper surface of the vehicle frame via at least one articulating joint. The at least one articulating joint connects the at least one load rest platform with a side face of the vehicle frame.

19 Claims, 10 Drawing Sheets

LOAD REST

BACKGROUND OF THE INVENTION

The invention concerns a forklift. Forklifts with load rest platforms which are arranged on a vehicle frame of the forklift are known in the art. A load which was raised by the forklift with the forks of its lifting system can be handed over to load rest platforms in order to increase the stability of the forklift and to relieve the lifting system of the forklift because the load rest platforms feed the force exerted by the weight of the load into the vehicle frame.

Known load rest platforms are movably arranged on the vehicle frame of a forklift. In particular, the load rest platforms are commonly movably mounted to the vehicle frame with one end of the platform. The load rest platforms can be pivoted or folded up from a storage position in which no load can be deposited on the load rest platforms to a working position in which a load can be deposited on the load rest platforms. In the working position the load rest platforms are usually aligned essentially horizontally and provide a storage surface for a load to be placed on the load rest platforms. An essentially horizontal alignment of the load rest platforms in the working position comprises not only a perfect horizontal alignment but also slightly inclined positions with respect to the horizontal which still allow a safe placement and storage of the load onto the load rest platforms. For example, a load rest platform—when moved to its working position—might be inclined towards the lifting system of the forklift to prevent the load from tipping down. Such inclination can be in the range between 0° and 10° related to the horizontal and would still be considered essentially horizontally.

Movably mounted load rest platforms known from prior art have an articulation mechanism that allows them to be moved from a from a storage position to a working position. That articulation mechanism is known to be arranged on and mounted to an upper surface of the vehicle frame, and further to be disposed between an upper surface of the vehicle frame and the load rest platforms. This arrangement generally brings the drawback of a high center of mass. Furthermore, this arrangement prevents the load rest platforms from being close to the vehicle frame when the load rest platforms are in the storage position. Both these issues negatively impact the performance of a forklift equipped with such load rest platforms.

Furthermore, load rest platforms known from prior art have to rely on complicated or even manually actuated mechanisms to define and retain the load rests in the working position and the storage position.

SUMMARY OF THE INVENTION

The purpose of the invention is to provide a forklift that does not have the above-mentioned drawbacks. This purpose is achieved by a forklift as described below.

At least one load rest platform is movably arranged on an upper surface of the vehicle frame via at least one articulating joint, wherein the at least one articulating joint connects the at least one load rest platform with a side face of the vehicle frame.

With the articulation mechanism, in particular the at least one articulating joint, being partially arranged at a side face of the vehicle frame (as a consequence of said joint connecting said platform with a side face), a lower center of mass may be achieved.

The placement of the at least one articulating joint on the side face of the vehicle frame allows for more freedom of design choices, such as shape and distance of the joint from the at least one load rest platform.

With the at least one articulating joint connecting the at least one load rest platform with a side face of the vehicle frame, parts of the articulation mechanism that allows the load rest platform to be moved can be arranged outside of the domain between the load rest platform and the upper surface of the vehicle frame. This can allow the load rest platform to be disposed closer to the vehicle frame when the load rest platform is in the storage position.

In other words, in one aspect of the invention, the at least one load rest platform is movably arranged above the vehicle frame while it connects to the same via at least one articulating joint that links the at least one load rest platform to a side of the vehicle frame, thus leaving more room below the at least one load rest platform and not negatively affecting its range of motion.

It may be of advantage that the at least one load rest platform is aligned essentially horizontally when moved to the storage position. In this way, the at least one load rest platform—when moved to the storage position—does not extend into the field of view of the forklift operator and does not cover headlights of the forklift.

Generally, the storage position is not suited for a load to be deposited on the at least one load rest platform. Conversely, the working position is suited for a load to be deposited on the at least one load rest platform.

As load rest platforms are not always needed, some embodiments of known load rest platforms can be moved or folded up from the working position to a storage position. Such known load rest platforms are pivotally arranged at the vehicle frame near a cabin of the forklift and can be pivoted folded up from the working position to the storage position and vice versa. In order to bring the known load rest platforms into the storage position they are pivoted towards the cabin of the forklift. In the storage position the load rest platforms are aligned essentially vertically or inclined towards the cabin. The pivotal axis is in the region of the front and lower end of the cabin. In order to be able to deposit a load onto the load rest platforms they need to extend longitudinally into the region of the forks in the working position. Due to their necessary lengths, when pivoted back or folded up to the storage position known load rest platforms extend into the field of view of the forklift operator and often cover headlights of the forklift.

In a preferred embodiment of the invention, the at least one load rest platform moves along an arc when moved between the storage position and the working position. In other words, the load rest platform can be moved—for instance in a translatory fashion—along a curved path when moved between the storage position and the working position.

In this regard, it can be of advantage if at least one load rest platform can remain aligned essentially horizontally when moved between the storage position and the working position. In this way, the at least one load rest platform is effectively displaced horizontally and vertically (but remains aligned essentially horizontally) when it is moved from the storage position to the working position. The at least one load rest platform can remain aligned essentially horizontally at all times during movement between the storage position and the working position.

The arc can have an apex in a vertical direction, wherein the at least one load rest platform is arranged below the apex in a vertical direction when moved to the working position.

The at least one load rest platform may be arranged below the apex in a vertical direction when moved to the storage position. The apex point may thus correspond to a dead point position, which may be passed during movement between the storage position and the working position and vice versa. In this way, once the load rest platform is in its working position, it will safely remain there. The load rest platform would have to be lifted upwards in the vertical direction and along the arc beyond the apex or dead point position in order to move it back to the storage position.

The vehicle frame of the forklift can generally be a U-shaped or horseshoe-shaped frame. The vehicle frame can comprise at least one longitudinal beam with an upper surface and at least one side face. For example, the two substantially straight legs of the U-shaped frame can each be provided in the form of a longitudinal beam with a certain cross-section, for example an I-shaped cross-section, a U-shaped cross-section or a rectangular cross-section. The at least one load rest platform can be movably arranged on the upper surface of the at least one longitudinal beam via the articulating joint, wherein the articulating joint connects the at least one load rest platform with the at least one side face of the at least one longitudinal beam, preferably in an end region of the at least one longitudinal beam.

The upper flange (and thus the upper surfaces) of the longitudinal beams may be of an offset or stepped shape. In other words, the longitudinal beams may have areas of different height in a lateral direction. This may enable parts of the load rest platforms, specifically the projecting flanges, to be arranged on or above the upper surfaces of the longitudinal beams.

It can be of particular advantage if the articulating joint is mounted or connected to the at least one side face of said at least one longitudinal beam via a mounting plate. The mounting plate may be attached to the at least one side face of the at least one longitudinal beam. Each load rest platform may be provided with its own dedicated mounting plate.

On a vehicle frame comprising two longitudinal beams forming a U-shaped vehicle frame, a load rest platform can be arranged on each of the side faces of the longitudinal beams. A forklift with such a U-shaped vehicle frame can substantially have its work implement located between the legs of the U-shaped frame, thus allowing a load picked up by the work implement to be set down onto the at least one load rest platform, effectively providing additional support on a wider support platform for the load. This may be of advantage for wide loads that extend past the frame width, for example loads like a stack of lumber or long length of flexible plastic pipes.

According to a preferred embodiment, the at least one load rest platform is aligned essentially parallel to and/or is substantially resting on the upper surface of the at least one longitudinal beam when moved to the storage position. Thereby, the at least one load rest platform practically rests on the at least one longitudinal beam when it is in its storage position.

The vehicle frame of the forklift can generally be a U-shaped or horseshoe-shaped frame, with each of the two substantially straight legs of the U-shaped frame being provided in the form of a longitudinal beam with a certain cross-section and an upper surface and a side face. A front wheel of the forklift can be arranged in an end region of the at least one longitudinal beam, wherein a connecting area of the articulating joint at the side face of the at least one longitudinal beam is in the region of the front wheel. A load is usually lifted by the lifting system of the forklift above the front wheels of the forklift. When the connecting area of the articulating joint is in the region of the front wheel, the load rest platform is exactly where needed. Furthermore, the longitudinal extension of both the articulating joint and the load rest platform can be optimized and limited in length.

In a preferred embodiment of the invention, the articulating joint comprises at least one joint lever, wherein the at least one joint lever is pivotally arranged at the side face of the at least one longitudinal beam around a first pivot axis and the at least one joint lever is pivotally arranged at the side face of the at least one load rest platform around a second pivot axis. The second pivot axis may essentially be parallel to the first pivot axis. The connecting area of the articulating joint at the side face of the at least one longitudinal beam—through which the first pivot axis extends—can be in the region of the front wheel. Preferably, the first pivot axis and the second pivot axis extend laterally to the longitudinal extent of the longitudinal beam, in particular perpendicularly to the side face of the at least one longitudinal beam.

The at least one load rest platform can comprise a projecting flange, wherein the at least one joint lever is pivotally arranged at the projecting flange. The load rest platform may be—at least sectionwise—of a T-shaped profile, of an L-shaped profile or of an (upside down) U-shaped profile. In the case of the load rest platform being of a U-shaped profile, the load rest platform may comprise two projecting flanges.

In a particularly preferred embodiment, the articulating joint comprises a first joint lever and a second joint lever, wherein the first pivot axes are spaced apart from each other in a longitudinal direction of the at least one longitudinal beam and the second pivot axes are spaced apart from each other in a longitudinal direction of the at least one load rest platform.

In a preferred embodiment, the vehicle frame comprises a first longitudinal beam with a first upper surface and a first side face, and a second longitudinal beam with a second upper surface and second side face. The forklift may further comprise a first load rest platform which is movably arranged on said first upper surface of the first longitudinal beam via a first articulating joint, wherein the first articulating joint connects the first load rest platform with the first side face of the first longitudinal beam. The forklift may still further comprise a second load rest platform which is movably arranged on the second upper surface of the second longitudinal beam via a second articulating joint, wherein the second articulating joint connects the second load rest platform with the second side face of the second longitudinal beam. The two articulating joints can each be configured as described above.

According to a further aspect, the at least one load rest platform is aligned essentially horizontally when moved to the working position, and the at least one load rest platform is movably arranged on the vehicle frame via at least one articulating joint comprising at least one joint lever, wherein the at least one joint lever has a stop surface for abutting against a stop device.

An abutment of the stop surface against the stop device may inhibit further pivotal movement of the joint lever in the direction of the stop surface. For example, a defined, self-locking working position and/or a defined storage position may be attained this way.

Any (normal) forces acting upon the load rest platform in the working position and/or the storage position may be transferred into the vehicle frame through the stop surface for abutting against the stop device.

In this regard it can be of advantage if the stop device is formed by the at least one load rest platform. In particular, the stop device may be formed by an underside of the load rest platform, with the stop surface abutting against said underside of the load rest platform for inhibiting further movement of the load rest platform in the direction of the stop surface.

According to a preferred embodiment, the at least one joint lever is of an angled layout or design—for instance the joint lever may be L-shaped—and comprises a first leg and a second leg, wherein the first leg and the second leg are arranged at an angle to each other.

In a preferred embodiment, the at least one joint lever has a stop surface for abutting against a stop device, wherein preferably the stop device is formed by the at least one load rest platform. The stop device may be formed by an underside of the at least one load rest platform. The stop surface can be arranged in the region of the angle or bend of the angled or L-shaped joint lever. In such an embodiment, when the stop surface of the at least one joint lever abuts against the stop device of the at least one load rest platform, a defined end position of the load rest platform (i.e. the working position or the storage position) can be reached and the load rest platform can securely remain in this position.

A stop device may be formed by the at least one load rest platform, and in the working position and/or the storage position of the at least one load rest platform the stop device may abut against the stop surface of the at least one joint lever.

In this regard, it can be of advantage if the at least one articulating joint comprises at least a first joint lever with a stop surface and at least a second joint lever with a stop surface, wherein in the working position and/or the storage position the stop device abuts against either one of said stop surfaces. In this case, when each of the two joint levers has a stop surface for abutting against a stop device of the load rest platform, both the working position and the storage position of the load rest platform can be defined.

Advantageously, the at least one load rest platform may be aligned essentially parallel to and/or may substantially be resting on said vehicle frame when moved to said storage position.

Although the invention is applicable to all types of forklifts, a preferred example of a forklift is a truck-mounted forklift.

BRIEF DESCRIPTION OF THE DRAWINGS

Embodiments of the invention are shown in the figures, wherein.

DETAILED DESCRIPTION OF THE INVENTION

Figure 1:
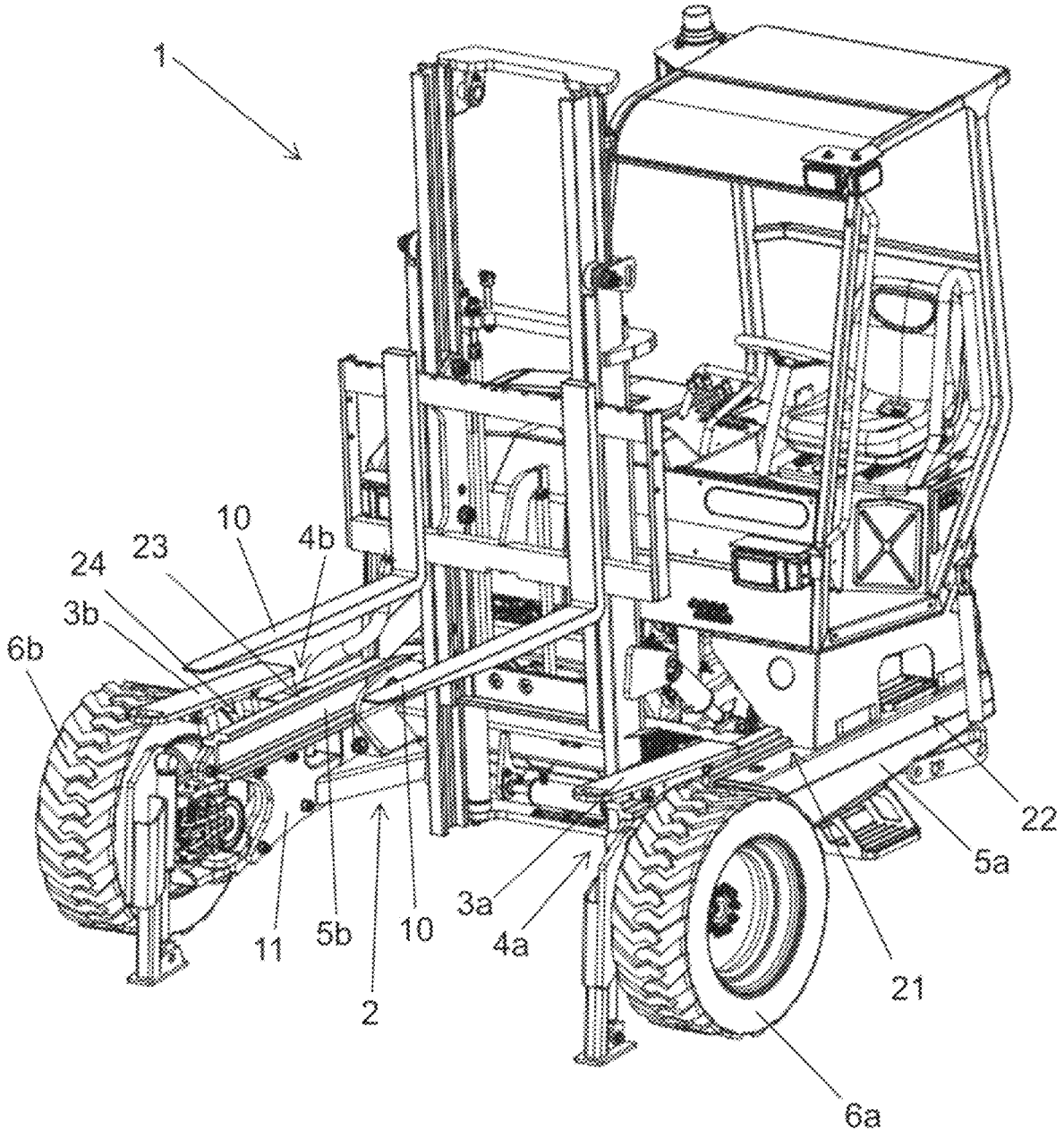
FIG. 1 shows a forklift in a perspective view with two load rest platforms in their working positions.

FIG. 1 shows a forklift 1 in a perspective view. The forklift 1 comprises a vehicle frame 2. The vehicle frame 2 comprises a first longitudinal beam 5*a* and a second longitudinal beam 5*b*. In this embodiment the longitudinal beams 5*a*, 5*b* are each of a substantially I-shaped cross-section. On each of the front ends of the longitudinal beams 5*a*, 5*b* a steerable front wheel 6*a*, 6*b* is arranged. Two load rest platforms 3*a*, 3*b* are movably arranged on upper surfaces 21, 23 on each of the longitudinal beams 5*a*, 5*b*. The first load rest platform 3*a* is movably arranged on the upper surface 21 on the first longitudinal beam 5*a* via a first articulating joint 4*a*, wherein the first articulating joint 4*a* connects the first load rest platform 3*a* with a side face 23 of the first longitudinal beam 5*a* (see FIGS. 9 to 12). Similarly, the second load rest platform 3*b* is movably arranged on the upper surface 23 on the second longitudinal beam 5*b* via a second articulating joint 4*b*, wherein the second articulating joint 4*b* connects the second load rest platform 3*b* with a side face 24 of the second longitudinal beam 5*b*. In this example, the articulating joints 4*a*, 4*b* are mounted or connected to the side faces 22, 24 of longitudinal beams 5*a*, 5*b* via mounting plates 11 (also see FIGS. 9 to 12 in this regard). Connecting areas of the articulating joints 4*a*, 4*b* at side faces 22, 24 of the longitudinal beams 5*a*, 5*b* are in the regions of the front wheels 6*a*, 6*b*.

Figure 2:
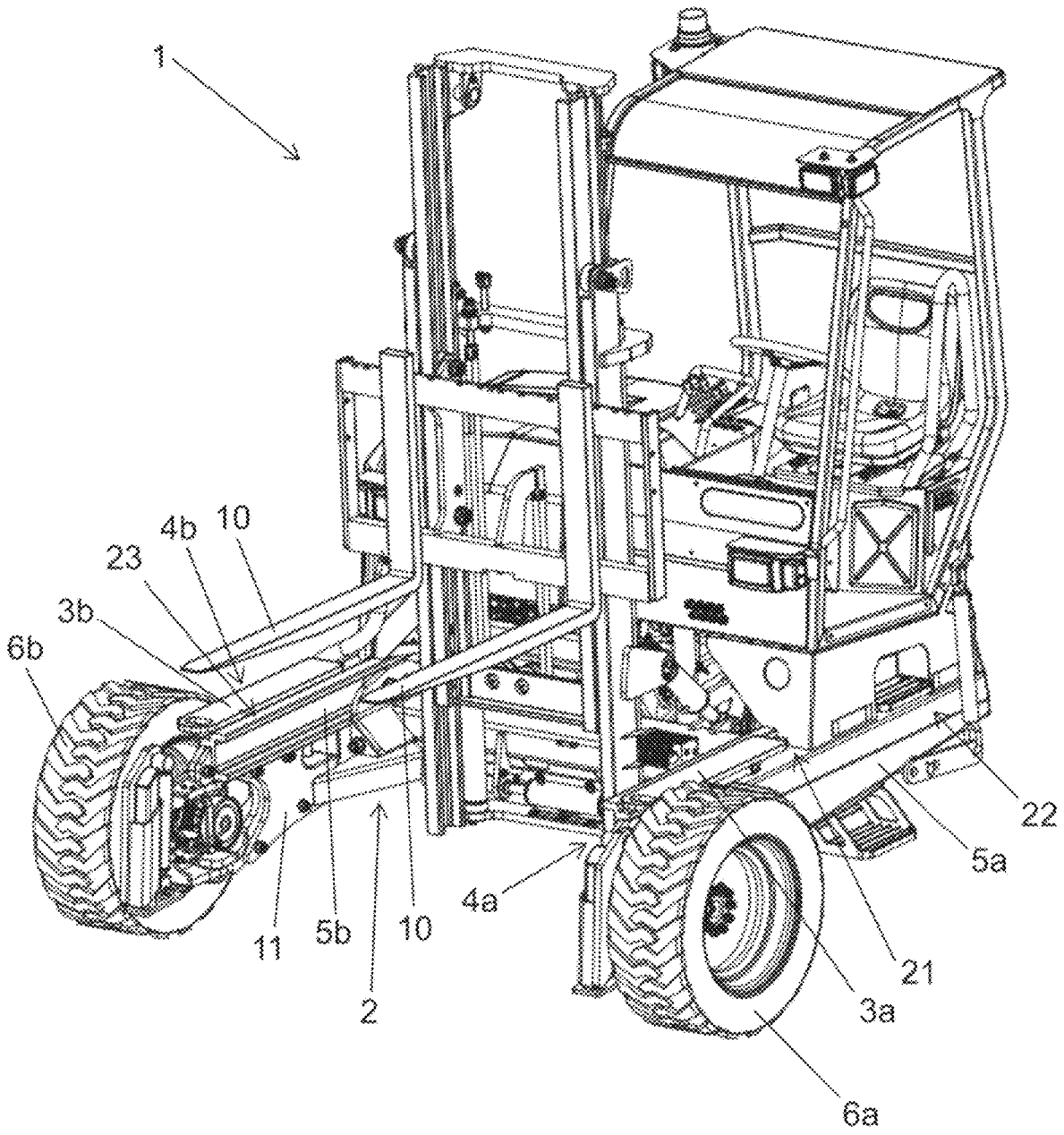
FIG. 2 shows the forklift of FIG. 1 with the load rest platforms in their storage positions.

In this embodiment the longitudinal beams 5*a*, 5*b* are each of a substantially I-shaped cross-section, wherein the upper flange of the longitudinal beams 5*a*, 5*b* is of an offset or stepped shape, as can clearly be seen from the end-profile of the longitudinal beams 5*a*, 5*b* in FIGS. 1 and 2. This enables parts of the load rest platforms 3*a*, 3*b*, specifically the projecting flanges 9, to be arranged on or above the upper surfaces 21, 23 of the longitudinal beams 5*a*, 5*b*.

The load rest platforms 3*a*, 3*b* extend longitudinally and provide a storage or support surface for a load to be placed or rested on the load rest platforms 3*a*, 3*b*. A lifting system of the forklift 1 comprises a load implement in form of forks 10 by which a load can be lifted and deposited on the load rest platforms 3*a*, 3*b* or their storage surfaces respectively.

In the illustration shown in FIG. 1, both load rest platforms 3*a*, 3*b* are in their respective working positions in which a load can be deposited on the load rest platforms 3*a*, 3*b*. In the working position, the load rest platforms 3*a*, 3*b* are aligned essentially horizontally and the load rest platforms 3*a*, 3*b* are located above the front wheels 6*a*, 6*b* in a vertical direction. In this example, the load rest platforms 3*a*, 3*b* are slightly inclined towards the lifting system or forks 10 of the forklift 1 in order to prevent a load which is deposited on the load rest platforms 3*a*, 3*b* from tipping down or rolling off the load rest platforms 3*a*, 3*b*. Such a slight inclination which still allows to easily deposit a load on the load rest platforms 3*a*, 3*b* is still considered as essentially horizontally in the context of this disclosure.

FIG. 2 shows the forklift according to FIG. 1, wherein the load rest platforms 3*a*, 3*b* were moved to their respective storage positions by means of the articulating joints 4*a*, 4*b*. The articulating joints 4*a*, 4*b* are configured such that the movement of the load rest platforms 3*a*, 3*b* from the working position to the storage position is along an arc A (see FIG. 13), wherein the load rest platforms 3*a*, 3*b* remain aligned essentially horizontally at all times when moved between their working positions and their storage positions. In their storage positions, the load rest platforms 3*a*, 3*b* are aligned essentially horizontally. Through the movement along arc A (see FIG. 13), the load rest platforms 3*a*, 3*b* are displaced horizontally and vertically (but still aligned essentially horizontally) when they are moved from their working positions to their storage positions. The movement between the working position and the storage position (and vice versa) can be effected manually or by means of a drive (e.g. an electric drive or a hydraulic drive).

In the example shown, in their storage positions the load rest platforms 3*a*, 3*b* are aligned essentially parallel to the upper surfaces 21, 23 of the longitudinal beams 5*a*, 5*b* and substantially rest on the longitudinal beams 5*a*, 5*b*. In this way, the load rest platforms 3*a*, 3*b* take up minimal space and do neither obstruct the view of the forklift operator nor do they cover headlights of the forklift 1.

Figure 3:
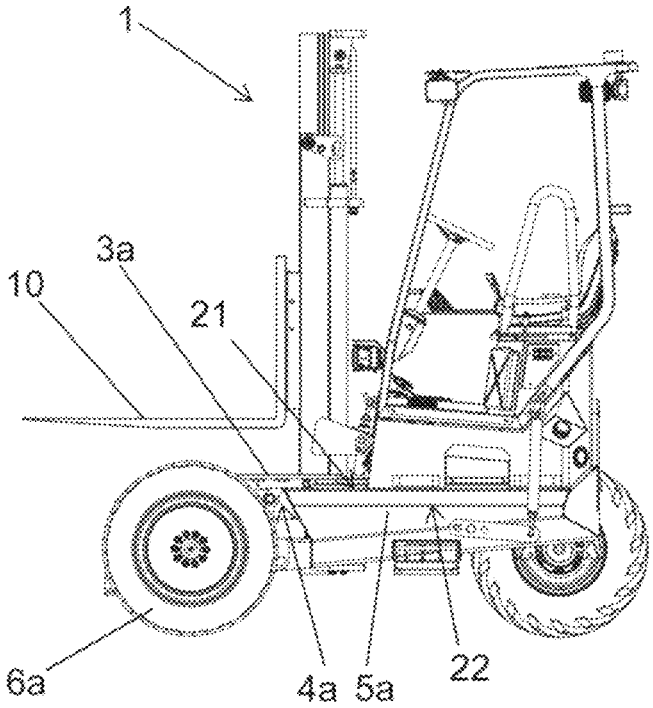
FIGS. 3 to 5 are side views on the forklift according to FIG. 1 with the load rest platforms moved to different positions.
Figure 4:
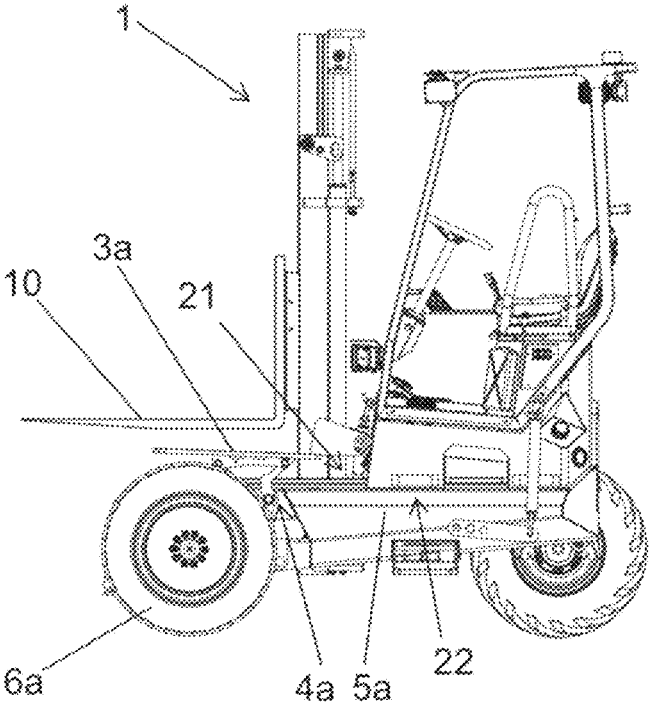
Figure 5:
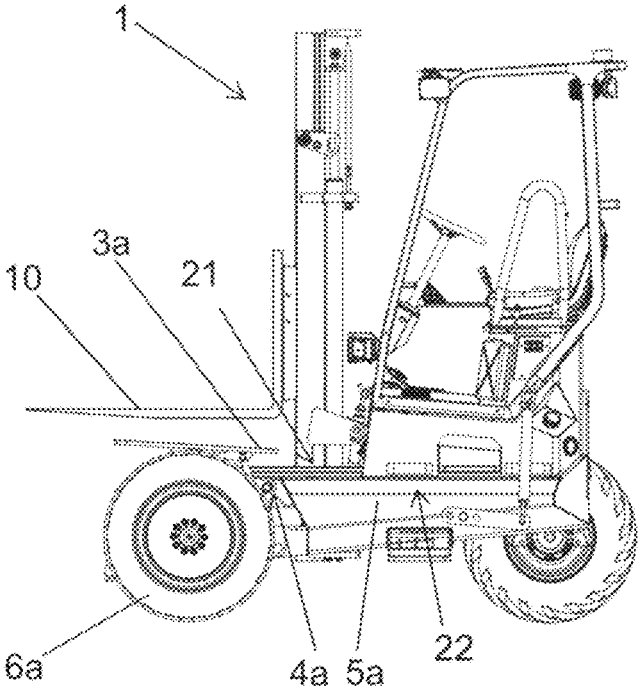

FIGS. 3 to 5 show side views of the forklift 1 according to FIG. 1, wherein the load rest platforms 3*a*, 3*b* are moved into different positions. In FIG. 3, the load rest platforms 3*a*, 3*b* are in their storage positions. In FIG. 5, the load rest platforms 3*a*, 3*b* are in their working positions. In FIG. 4, the load rest platforms 3*a*, 3*b* are in an intermediate position between their storage positions and their working positions.

Figure 6:
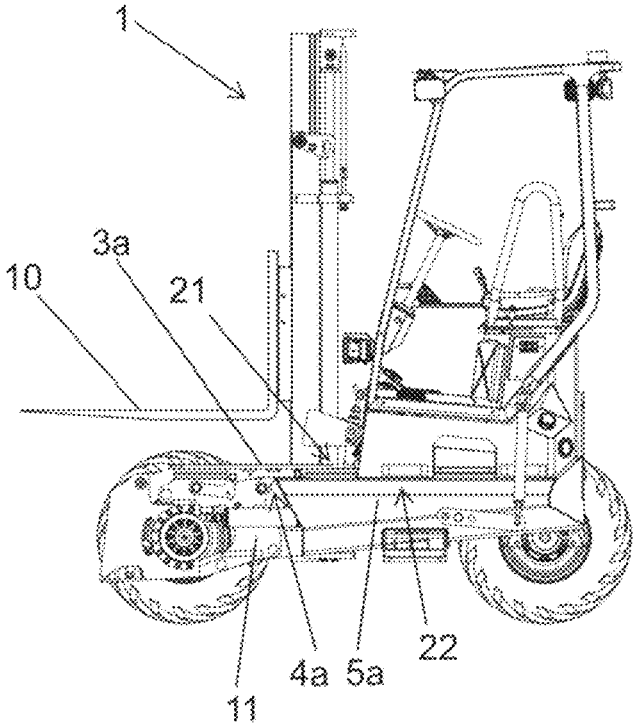
FIGS. 6 to 8 are side views according to FIGS. 3 to 5, wherein a front wheel of the forklift is hidden.
Figure 7:
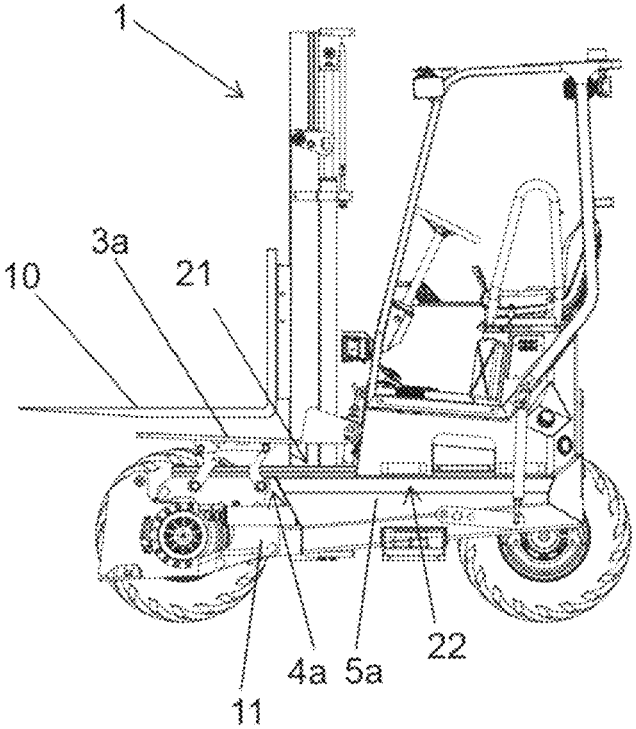
Figure 8:
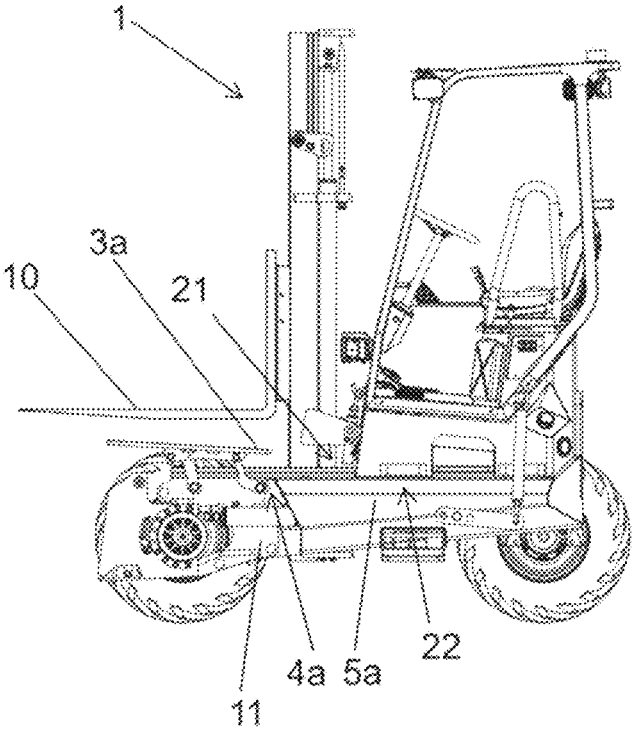

FIGS. 6 to 8 show the illustrations according to FIGS. 3 to 5, wherein the front wheel 6*a* is hidden in order to allow a better view on the first load rest platform 3*a* and on the first articulating joint 4*a* which connects the first load rest platform 3*a* with the side face 22 of the first longitudinal beam 5*a*.

The following description refers to the first load rest platform 3*a* and the first articulating joint 4*a* only. However, the description is of course also applicable to the second load rest platform 3*b* and the second articulating joint 4*b* which connects the second load rest platform 3*b* with the side face 24 of the second longitudinal beam 5*b*.

As can be seen in FIGS. 3 and 6, the first load rest platform 3*a* is aligned essentially parallel to the upper surface 21 of the first longitudinal beam 5*a*. In this example, the first load rest platform 3*a* also practically rests on the upper surface 21 of the longitudinal beam 5*a* in its storage position. When moved from the storage position to the working position (see FIGS. 5 and 8), the first load rest platform 3*a* is moved along an arc A (see FIG. 13), wherein arc A has an apex AA in a vertical direction (see the intermediate position of the first load rest platform 3*a* in FIGS. 4 and 7 in which the first load rest platform 3*a* is located higher in the vertical direction than in its storage position and in its working position). The first load rest platform 3*a* is arranged below the apex AA in a vertical direction when moved to its working position and the first load rest platform 3*a* is also arranged below the apex AA in a vertical direction when moved to its storage position. In this way, once the first load rest platform 3*a* is in one of its end positions (i.e. the working position or the storage position) it will safely remain there. The first load rest platform 3*a* would have to be lifted in the vertical direction up and along arc A beyond the apex AA in order to move it back to the other end position.

Figure 9:
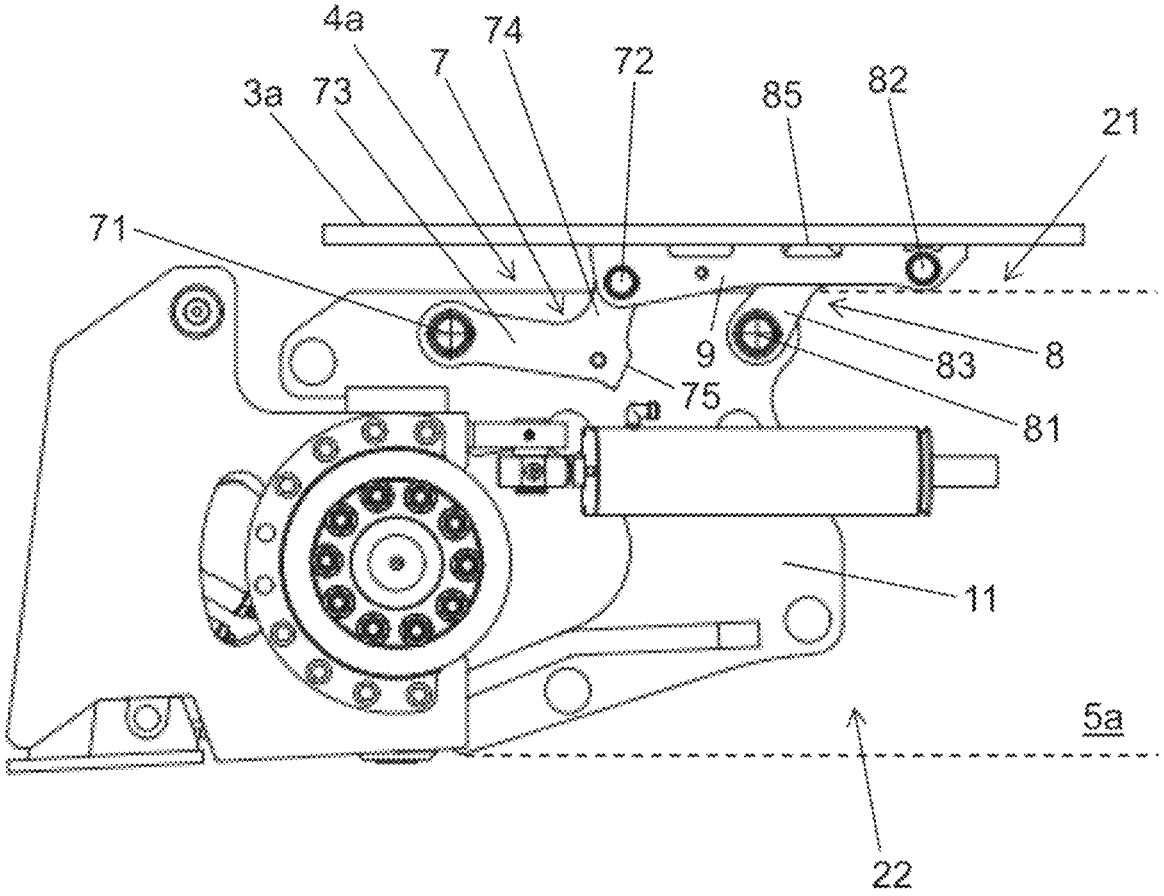
FIGS. 9 to 12 are detailed side views on a load rest platform movably arranged on a longitudinal beam via an articulating joint, wherein the load rest platform is moved to different positions.
Figure 10:
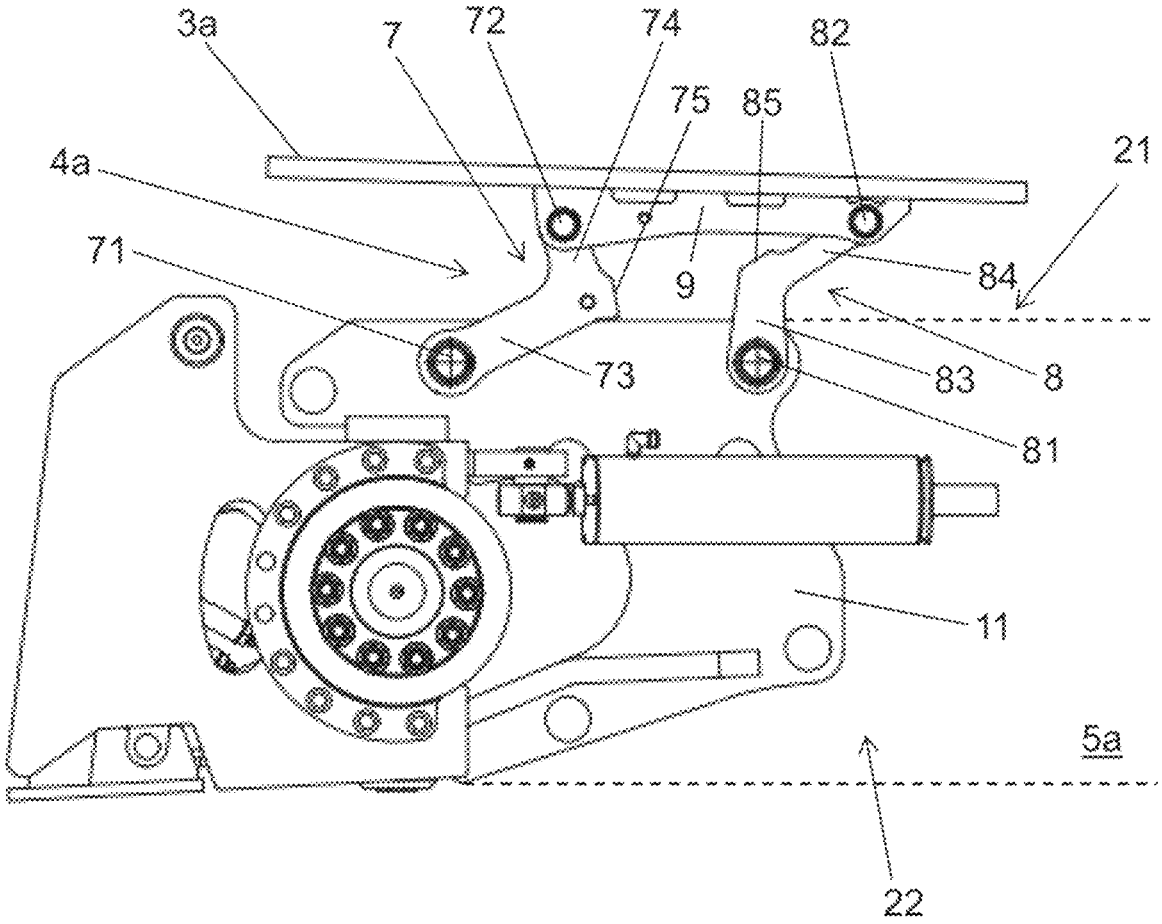
Figure 11:
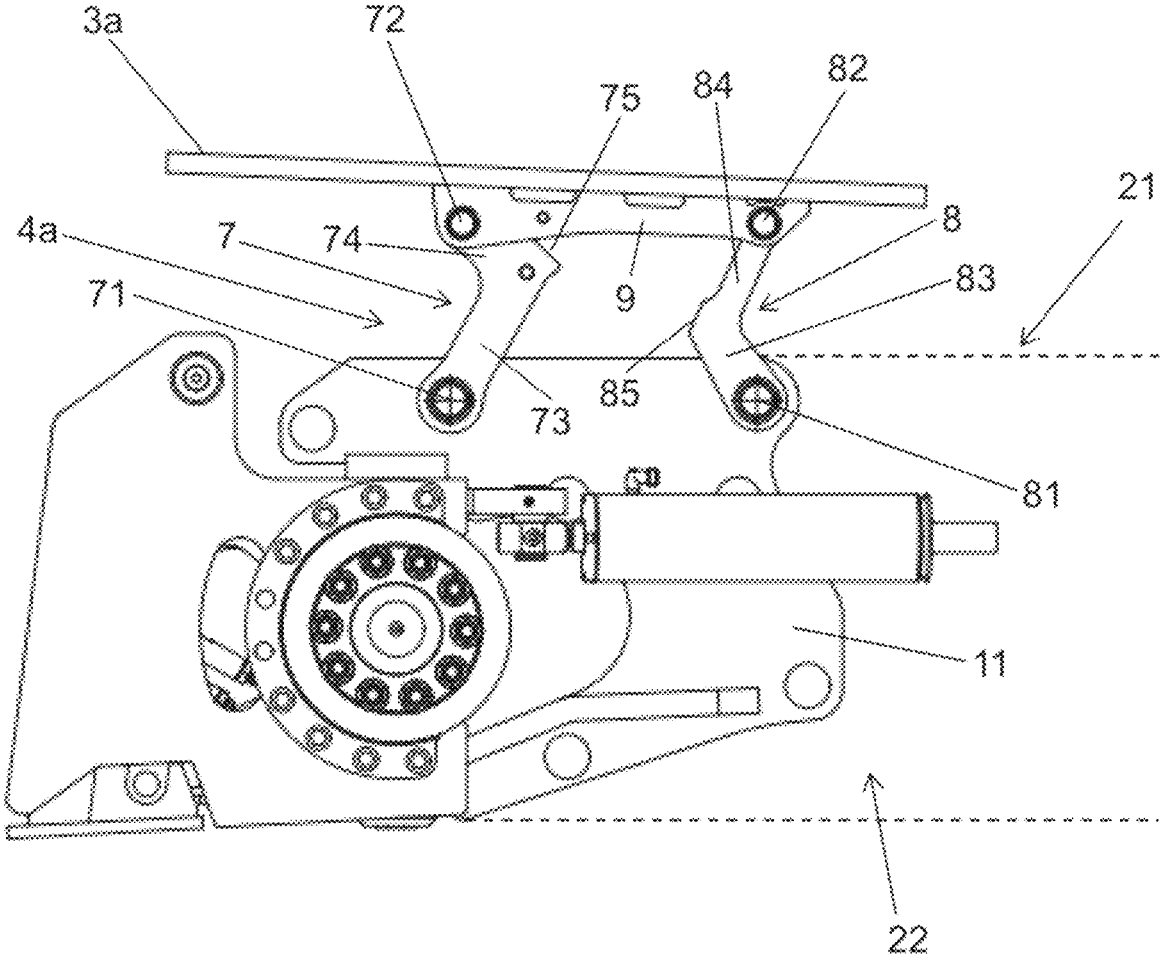
Figure 12:
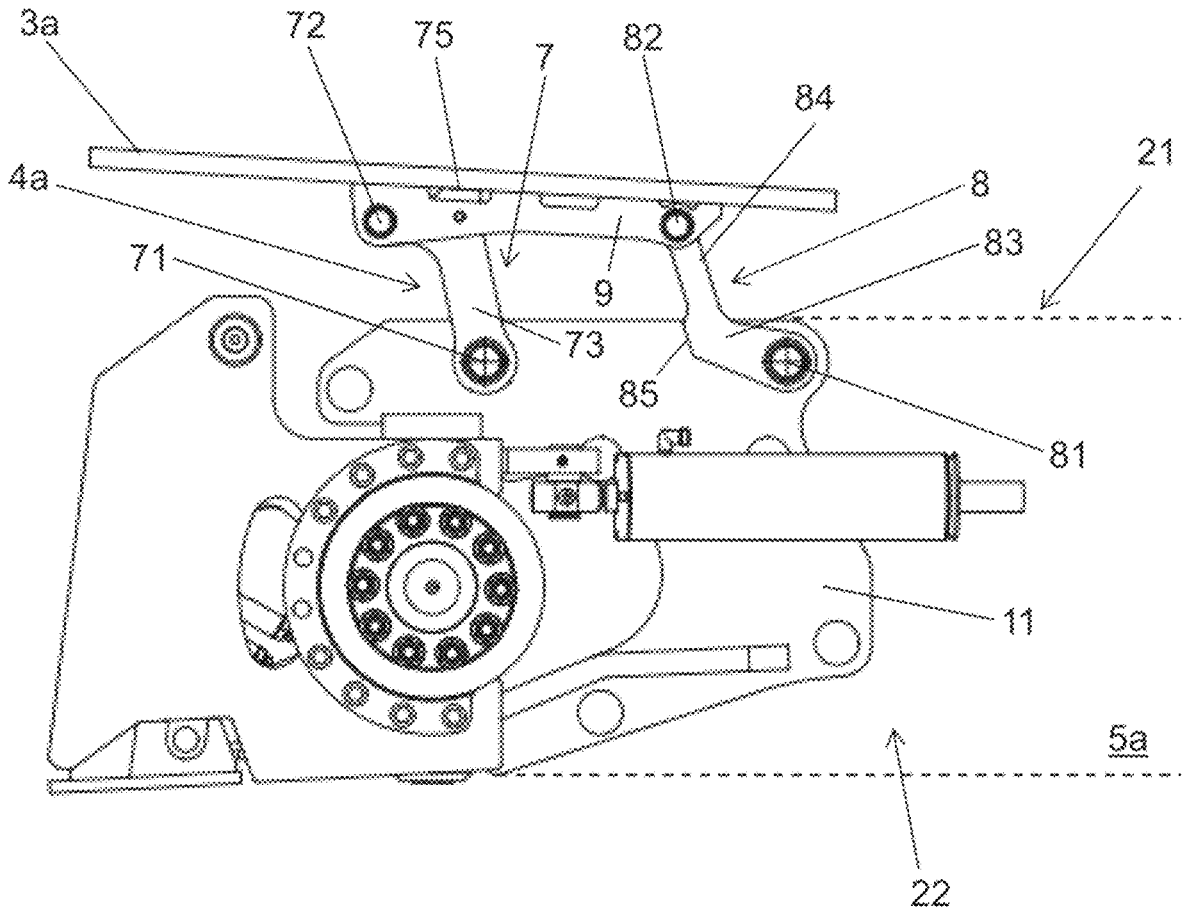

FIGS. 9 to 12 show detailed views of the first load rest platform 3*a* and of the first articulating joint 4*a*, wherein the first load rest platform 3*a* is moved into different positions. In FIG. 9, the first load rest platform 3*a* is in its storage position. In FIG. 12, the load rest platform 3*a* is in its working position. FIGS. 10 and 11 show two different intermediate positions of the first load rest platform 3*a* when moved from its storage position to its working position. In these figures, the outline of the first longitudinal beam 5*a* with its upper surface 21 and its side face 22 is schematically indicated with dashed lines.

The first load rest platform 3*a* is movably arranged on the first longitudinal beam 5*a* via the first articulating joint 4*a*, wherein the first articulating joint 4*a* connects the first load rest platform 3*a* with the first longitudinal beam 5*a* in an end region of the first longitudinal beam 5*a*. The first articulating joint 4*a* is mounted or connected to the first longitudinal beam 5*a* via a mounting plate 11.

The first articulating joint 4*a* comprises a first joint lever 7 and a second joint lever 8. The first joint lever 7 is pivotally arranged at the side face 22 of the first longitudinal beam 5*a* around a first pivot axis 71 and it is pivotally arranged at the first load rest platform 3*a* around a second pivot axis 72. The second pivot axis 72 is essentially parallel to the first pivot axis 71. Both the first pivot axis 71 and the second pivot axis 72 extend transverse to the longitudinal extent of the first longitudinal beam 5*a*.

Similarly, the second joint lever 8 is pivotally arranged at the side face 22 of first longitudinal beam 5*a* around a first pivot axis 81 and it is pivotally arranged at the first load rest platform 3*a* around a second pivot axis 82. The second pivot axis 82 is essentially parallel to the first pivot axis 81. Both the first pivot axis 81 and the second pivot axis 82 extend transverse to the longitudinal extent of the first longitudinal beam 5*a*.

The first pivot axes 71, 81 are spaced apart from each other in a longitudinal direction of the first longitudinal beam 5*a* and the second pivot axes 72, 82 are spaced apart from each other in a longitudinal direction of the first load rest platform 3*a*.

In this example the first load rest platform 3*a* comprises a projecting flange 9, wherein the two joint levers 7, 8 are pivotally arranged at the projecting flange 9. The projecting flange 9 projects essentially perpendicularly from an underside of the first load rest platform 3*a* and the second pivot axes 72, 82 extend through the projecting flange 9. The two joint levers 7, 8 are configured such that the distance between the first pivot axis 71 and the second pivot axis 72 of the first joint lever 7 is essentially the same as the distance between the first pivot axis 81 and the second pivot axis 82 of the second joint lever 8. As the distance between the underside of the first load rest platform 3*a* and the second pivot axis 72 of the first joint lever 7 is slightly greater than the distance between the underside of the first load rest platform 3*a* and the second pivot axis 82 of the second joint lever 8 the first load rest platform 3*a* is slightly inclined to the horizontal in its working position (see FIG. 12), such slight inclination still be considered as an essentially horizontally alignment of the first load rest platform 3*a*.

Each of the two joint levers 7, 8 is of an angled or L-shaped configuration and comprises a first leg 73, 83 and a second leg 74, 84, wherein the first leg 73, 83 and the second leg 74, 84 are arranged at an angle to each other. The bends or angles of the angular or L-shaped joint levers 7, 8 are oriented towards each other. In the region of the bends or angles the two joint levers 7, 8 have a stop surface 75, 85 for abutting against a stop device in order to limit the movement of the first load rest platform 3*a*. In the example shown, the stop device is formed by the first load rest platform 3*a*, or more specifically an underside of the first load rest platform 3*a*. Upon moving the first load rest platform 3*a* towards its storage position (see FIG. 9), the joint levers 7, 8 pivot clockwise around the first pivot axes 71, 81 until the stop surface 85 of the second joint lever 8 abuts against the underside of the first load rest platform 3*a*. In this way the stop surface 85 of the second joint lever 8 limits the movement of the first load rest platform 3*a* and defines the storage position of the first load rest platform 3*a*

(see FIG. 9). In a similar way, on moving the first load rest platform 3*a* towards its working position (see FIG. 12) the joint levers 7, 8 pivot counterclockwise around the first pivot axes 71, 81 until the stop surface 75 of the first joint lever 7 abuts against the underside of the first load rest platform 3*a*. In this way the stop surface 75 of the first joint lever 7 limits the movement of the first load rest platform 3*a* and defines the working position of the first load rest platform 3*a*.

Figure 13:
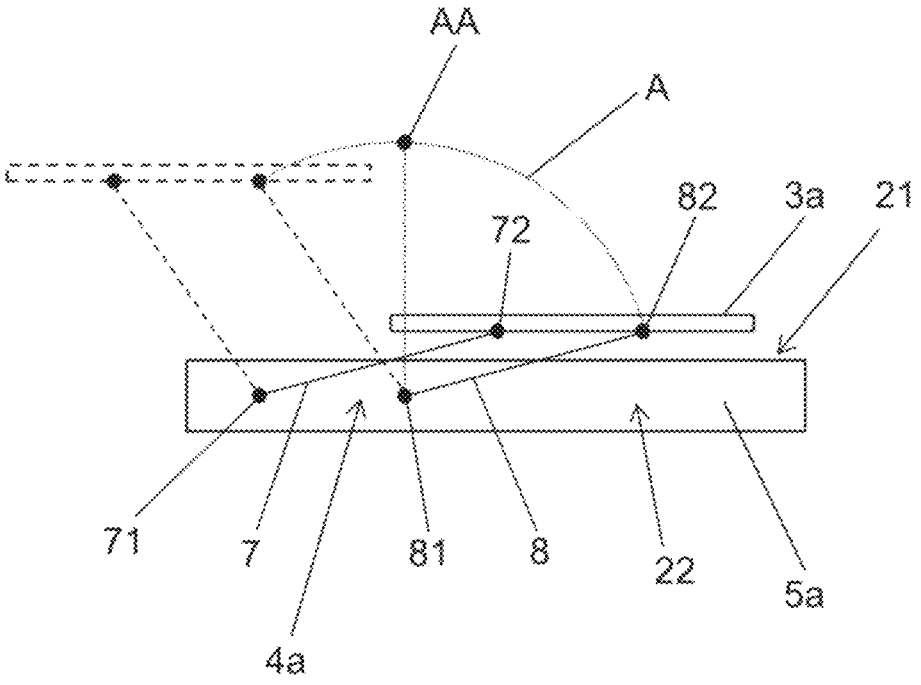
FIG. 13 is a schematic illustration of a load rest platform movably arranged on a longitudinal beam via an articulating joint.

FIG. 13 shows a schematic illustration of a load rest platform 3*a* movably arranged on a longitudinal beam 5*a* via an articulating joint 4*a*. The storage position of the load rest platform 3*a* is shown in solid lines and the outline of the working position of the load rest platform 3*a* is shown in dashed lines.

The articulating joint 4*a* comprises a first joint lever 7 and a second joint lever 8. The first joint lever 7 is pivotally arranged at the side face 22 of the longitudinal beam 5*a* around a first pivot axis 71 and it is pivotally arranged at the load rest platform 3*a* around a second pivot axis 72. The second joint lever 8 is pivotally arranged at the side face 22 of the longitudinal beam 5*a* around a first pivot axis 81 and it is pivotally arranged at the load rest platform 3*a* around a second pivot axis 82. The first pivot axes 71, 81 are spaced apart from each other in a longitudinal direction of the longitudinal beam 5*a* and the second pivot axes 72, 82 are spaced apart from each other in a longitudinal direction of the load rest platform 3*a*.

The load rest platform 3*a* moves along an arc A when moved between its storage position and its working position, wherein the load rest platform 3*a* remains aligned essentially horizontally at all times when moved between the storage position and the working position. The arc A has an apex AA in a vertical direction, wherein the load rest platform 3*a* is arranged below the apex AA in a vertical direction when moved to its working position. In addition, the load rest platform 3*a* is also arranged below the apex AA in a vertical direction when moved to its storage position. The apex point AA thus corresponds to a dead point position, which may be passed during movement between the storage position of the load rest platform 3*a* and the working position of the load rest platform 3*a* and vice versa. This way, once the load rest platform 3*a* is in its working position, it will securely remain there. The load rest platform would have to be lifted upwards in the vertical direction and moved along the arc A beyond the apex or dead point position in order to move it back to the storage position.

LIST OF REFERENCE SIGNS

1 forklift
2 vehicle frame
21, 23 upper surface
22, 24 side face
3*a*, 3*b* load rest platform
4*a*, 4*b* articulating joint
5*a*, 5*b* longitudinal beam
6*a*, 6*b* front wheel
7, 8 joint lever
71, 81 first pivot axis
72, 82 second pivot axis
73, 83 first leg
74, 84 second leg
75, 85 stop surface
9 projecting flange
10 fork
11 mounting plate
A arc
AA apex

The invention claimed is:

1. A forklift comprising:

a vehicle frame; and a load rest platform movably arranged on said vehicle frame, wherein said load rest platform is movable between a storage position in which no load can be deposited on said load rest platform and a working position in which a load can be deposited on said load rest platform, wherein said load rest platform is aligned essentially horizontally when moved to said working position, wherein said load rest platform is movably arranged on an upper surface of said vehicle frame via an articulating joint, and said articulating joint connects said load rest platform with a side face of said vehicle frame, wherein said vehicle frame comprises a longitudinal beam with an upper surface and a side face, wherein said load rest platform is movably arranged on said upper surface of said longitudinal beam via said articulating joint, wherein said articulating joint connects said load rest platform with said side face of said longitudinal beam, and wherein said articulating joint comprises a first joint lever and a second joint lever, each of said first joint lever and said second joint lever being pivotally arranged at said side face of said longitudinal beam around a first pivot axis and being pivotally arranged at said load rest platform around a second pivot axis, said first pivot axes of said first joint lever and said second joint lever being spaced apart from each other in a longitudinal direction of said side face of said longitudinal beam, and said second pivot axes of said first joint lever and said second joint lever being spaced apart from each other in a longitudinal direction of said load rest platform.

2. The forklift according to claim 1, wherein said load rest platform is aligned essentially horizontally when moved to said storage position.

3. The forklift according to claim 1, wherein said load rest platform moves along an arc when moved between said storage position and said working position.

4. The forklift according to claim 3, wherein said load rest platform remains aligned essentially horizontally when moved between said storage position and said working position.

5. The forklift according to claim 1, wherein said arc has an apex in a vertical direction, and said load rest platform is arranged below said apex in a vertical direction when moved to said working position.

6. The forklift according to claim 5, wherein said load rest platform is also arranged below said apex in a vertical direction when moved to said storage position.

7. The forklift according to claim 1, wherein said articulating joint connects said load rest platform with said side face of said longitudinal beam in an end region of said longitudinal beam.

8. The forklift according to claim 1, wherein said articulating joint is mounted or connected to said side face of said longitudinal beam via a mounting plate.

9. The forklift according to claim 1, wherein said load rest platform is aligned essentially parallel to and/or is substantially resting on said upper surface of said longitudinal beam when moved to said storage position.

10. The forklift according to claim 1, wherein a front wheel of said forklift is arranged in an end region of said longitudinal beam, wherein a connecting area of said articulating joint on said side face of at said longitudinal beam is in the region of said front wheel.

11. The forklift according to claim 1, wherein said second pivot axis is essentially parallel to said first pivot axis.

12. The forklift according to claim 1, wherein said load rest platform comprises a projecting flange, wherein said joint lever is pivotally arranged at said projecting flange.

13. The forklift according to claim 1, wherein said vehicle frame comprises a first longitudinal beam with a first upper surface and a first side face, and a second longitudinal beam with a second upper surface and second side face, wherein said forklift comprises a first load rest platform which is movably arranged on said first upper surface of said first longitudinal beam via a first articulating joint, wherein said first articulating joint connects said first load rest platform with said first side face of said first longitudinal beam, wherein said forklift comprises a second load rest platform which is movably arranged on said second upper surface of said second longitudinal beam via a second articulating joint, wherein said second articulating joint connects said second load rest platform with said second side face of said second longitudinal beam.

14. The forklift according to claim 1, wherein said forklift is a truck-mounted forklift.

15. A forklift comprising:

a vehicle frame; and a load rest platform movably arranged on said vehicle frame, wherein said load rest platform is movable between a storage position in which no load can be deposited on said load rest platform and a working position in which a load can be deposited on said load rest platform, wherein said load rest platform is aligned essentially horizontally when moved to said working position, wherein said load rest platform is movably arranged on said vehicle frame via an articulating joint comprising a joint lever, said joint lever having a stop surface for abutting against a stop device, and wherein said joint lever has an angled shape and comprises a first leg and a second leg, said first leg and said second leg being arranged at an angle to each other.

16. The forklift according to claim 15, wherein said stop device is formed by said load rest platform.

17. The forklift according to claim 15, wherein a-said stop device is formed by said load rest platform and such that, in the working position and/or the storage position of said load rest platform, said stop device abuts against said stop surface of said joint lever.

18. The forklift according to claim 15, wherein said load rest platform is aligned essentially parallel to and/or substantially resting on said vehicle frame when moved to said storage position.

19. A forklift comprising:

a vehicle frame; and a load rest platform movably arranged on said vehicle frame, wherein said load rest platform is movable between a storage position in which no load can be deposited on said load rest platform and a working position in which a load can be deposited on said load rest platform, wherein said load rest platform is aligned essentially horizontally when moved to said working position, wherein said load rest platform is movably arranged on said vehicle frame via an articulating joint having a stop surface for abutting against a stop device, wherein said stop device is formed by said load rest platform, and wherein said stop surface comprises a first stop surface and a second stop surface, and said articulating joint comprises a first joint lever with said first stop surface and a second joint lever with said second stop surface, and wherein, in the working position and/or the storage position, the stop device abuts against either one of said first stop surface and said second stop surface.

* * * * *